US005148630A

United States Patent [19]

Llorens

[11] Patent Number: 5,148,630

[45] Date of Patent: Sep. 22, 1992

[54] SECURITY ASSEMBLY FOR A SLIDING GLASS DOOR

[76] Inventor: Mario Llorens, 310 W. 36th Ter., Hialeah, Fla. 33012

[21] Appl. No.: 782,087

[22] Filed: Oct. 24, 1991

[51] Int. Cl.[5] ..... E05D 13/00

[52] U.S. Cl. ..... 49/425; 16/100

[58] Field of Search ..... 49/404, 425, 427; 16/97, 100

[56] References Cited

U.S. PATENT DOCUMENTS

| | | | |
|---|---|---|---|
| 1,019,129 | 3/1912 | Campbell | 16/100 |
| 1,188,865 | 6/1916 | Wexler | 49/404 |
| 3,033,285 | 5/1962 | Banner | 49/425 |
| 3,167,112 | 1/1965 | Tucker | 49/425 |
| 3,745,706 | 7/1973 | Stermac | 49/425 |
| 3,956,854 | 5/1976 | Yamamoto | 49/425 |
| 4,065,592 | 12/1977 | Riegelman et al. | 16/100 |
| 4,633,615 | 1/1987 | Moose | 49/425 |

FOREIGN PATENT DOCUMENTS

| | | | |
|---|---|---|---|
| 243227 | 12/1960 | Australia | 49/425 |
| 663726 | 5/1963 | Canada | 49/425 |
| 960915 | 1/1975 | Canada | 49/425 |
| 2601408 | 1/1988 | France | 49/425 |
| 184330 | 8/1922 | United Kingdom | 16/100 |

*Primary Examiner*—Renee S. Luebke
*Assistant Examiner*—Michael J. Milano
*Attorney, Agent, or Firm*—Malloy, Downey & Malloy

[57] ABSTRACT

A security assembly for a sliding glass door of the type movably fitted within a generally rectangular supporting frame structure wherein a bottom sash includes an open channel having rollers therein for rollable engagement with a rail extending along the length of a sill of the supporting frame. Two pair of J-shaped fittings are removably attachable with a lower edge of the bottom sash at opposite ends thereof such that a hooked portion of each fitting extends upwardly within one of two longitudinal grooves formed on opposite lower sides of the rail thereby preventing lifting and removal of the door from its fitted position within the supporting frame structure.

5 Claims, 1 Drawing Sheet

SECURITY ASSEMBLY FOR A SLIDING GLASS DOOR

BACKGROUND OF THE INVENTION

1. Field of the Invention

The present invention relates to a security assembly for preventing the unauthorized removal of a sliding glass door from its mounted, operable position within a supporting frame structure.

2. Description of the Related Art

One of the most common methods of entry used by burglars breaking into a home or other building is achieved by lifting a sliding glass door from its seated position on the track or rail of a supporting frame structure. This is generally accomplished by inserting a screw driver or other like instrument under a lower edge of the bottom sash of the door and prying upwardly so as to lift the rollers and bottom edge of the sash up over the rail where it is then easy to remove the door from the supporting frame structure.

While there have been attempts in the past to prevent the inadvertent derailing of sliding glass doors and other like structures, there does not exist an assembly which is specifically designed to prevent the unauthorized removal of a sliding glass door from its mounted, operable position within the supporting frame structure by lifting the door off its seated position on the rail of the frame structure. One such apparatus for preventing the accidental detachment of sashes of windows, doors and the like from the supporting frame structure is disclosed in the U.S. Pat. No. 3,956,854 to Yamamoto. The Yamamoto apparatus includes a pair of resilient hooks having inwardly folding bottom ends engageable with respective overhangs on both sides of the rail throughout its full length. While the resilient hooks are effective for their intended purpose of preventing the rollers on the bottom sash from accidentally running off the rail, they will not prevent a burglar from prying the bottom sash upwardly from its supported position on the rail.

Accordingly, there is a need in the present sliding glass door and related window art for an assembly specifically designed to prevent the unauthorized removal of a sliding glass door or sliding window from its mounted, operable position within a supporting frame structure.

SUMMARY OF THE INVENTION

It is, therefore, among the objects of the present invention to provide, in a sliding glass door or like window assembly having at least one bottom, horizontal sash rollably mounted to a track on the seal of a supporting frame structure, a security assembly for preventing the unauthorized removal of the sliding glass door from its mounted, operable position within the supporting frame structure.

It is another object of the present invention to provide a security assembly adapted to prevent the unauthorized prying and lifting of the bottom sash of a sliding glass door from its operable, seated position on the track of a supporting frame structure.

It is still a further object of the present invention to provide a security assembly for preventing the unauthorized lifting and removal of a sliding glass door from its mounted, operable position within a supporting frame structure wherein the assembly is relatively inexpensive to manufacture and easy to install.

With these and other objects in view, this invention provides, in a sliding glass door or like window arrangement wherein at least one bottom sash is rollable horizontal with a supporting frame structure, the novel combination which includes a rail formed on the seal of the supporting frame being structured and configured for rolling engagement with a plurality of rollers mounted within an open channel formed within a lower end along the length of the bottom sash. The rail includes a pair of opposite, longitudinally extending grooves on an under side thereof. Two pairs of J-shaped fittings are each removably attachable near opposite ends of the bottom sash, respectively, with two fittings of each pair disposed on opposite sides of the sash such that a hook-shaped portion of each fitting extends upwardly within a corresponding one of the two grooves of the track so as to effectively prevent the unauthorized lifting and removal of the bottom sash and attached door from its rolling engagement on the track. The J-shaped fittings are formed of a substantially rigid material such as steel so that it is nearly impossible to bend them by prying a screwdriver or other instrument under the sash.

The features which are believed to be novel and characteristic of this invention are set forth in particular in the claims appended hereto. The invention itself, however, both as to its construction and mode of operation, together with the further objects and advantages thereof, will be apparent from the following description of the preferred embodiment when read in connection with the accompanying drawings in which like reference numerals refer to like parts throughout the several views.

DETAILED DESCRIPTION OF THE PREFERRED EMBODIMENT

Figure 1:
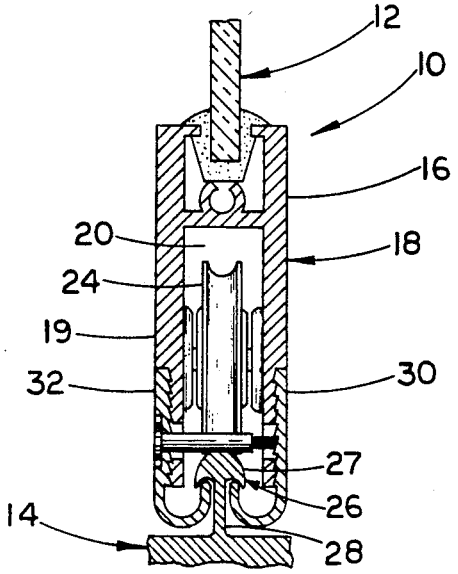
FIG. 1 is a partial sectional view illustrating a preferred embodiment of the present invention for preventing the unauthorized lifting and removal of a horizontally rolling sash of a sliding glass door or the like from the track of a supporting frame, structure.
Figure 2:
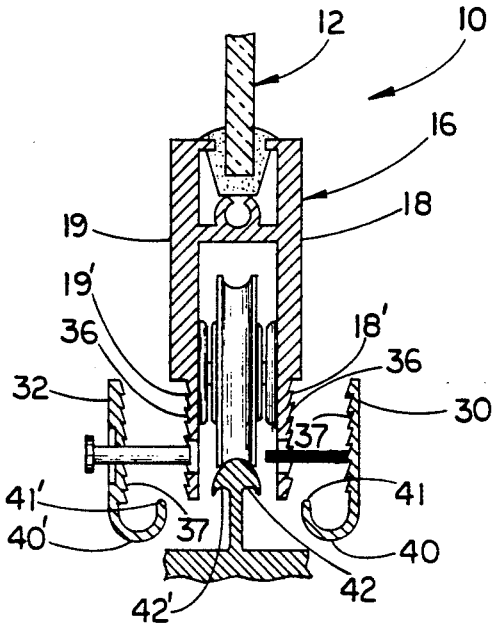
FIG. 2 is a partial sectional view similar to FIG. 1 illustrating the removable attachment of a pair of J-shaped fittings to the bottom sash of a sliding glass door.

The present invention will now be described according to a preferred embodiment as best illustrated in FIGS. 1 and 2. The present invention is directed to a security assembly generally indicated as 10 to prevent the unauthorized lifting and removal of a sliding glass door 12 from its mounted, operable position within a supporting frame structure 14. The assembly includes a bottom, generally horizontal sash 16 having opposite, downwardly extending side walls 18 and 19 disposed in spaced relation from one another so as to form an open ended channel 20 formed therebetween.

Generally, at least two rollers 24 are vertically mounted within the channel 20 (only one being shown in the drawings) with the roller being rollably engageable with a rail 26 extending upwardly from a bottom sill of the supporting frame structure 14, the rail 26 including a head portion 27 and a web portion 28. Accordingly, the bottom sash 16 and remaining sliding glass door 12 is rollably movable relative to the supporting frame structure 24 and rail 26.

In accordance with the preferred embodiment of the present invention, a pair of J-shaped members formed of a substantially rigid steel, including a first J-shaped member 30 and a second J-shaped member 32 are each removably attachable to one of the two opposite side walls 18 and 19 as illustrated in FIG. 2. The lower portion of the side walls 18 and 19 comprises an area of reduced thickness 18' and 19' so as to accommodate a flush mounting of the J-shaped fittings 30 and 32 thereto. An outer exposed surface of the lower portions 18' and 19' of the opposite side walls 18 and 19 includes a serrated surface 36 which is adapted for locking engagement with a congruently configured serrated surface 37 on an inner side of each of the first and second J-shaped members 30 and 32, respectively.

Each of the J-shaped members 30 and 32 include a lower hooked portion 40 and 40' being formed and configured so as to extend upwardly so that a free distal end 41, 41' is disposed within a corresponding groove 42, 42' formed in a lower side of the head 27 of the rail 26 and extending along a length thereof.

Figure 3:
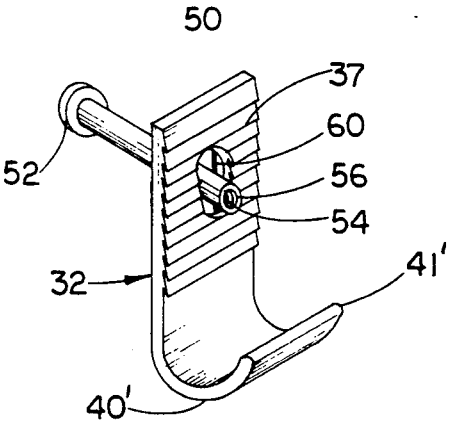
FIG. 3 is a perspective view of one J-shaped fitting with an attachment member extending through a slot formed therein.
Figure 4:
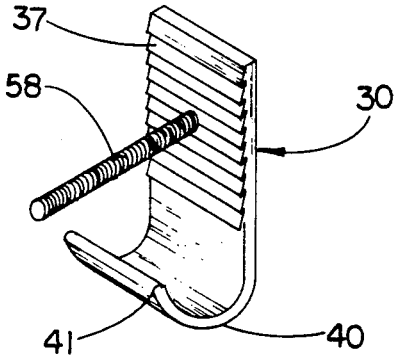
FIG. 4 is a perspective view of another J-shaped fitting having an elongate attachment member extending from an inner surface thereof.
Figure 5:
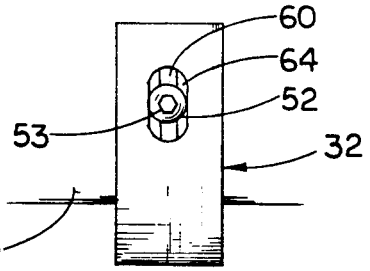
FIG. 5 is a side plan view of an outer side of the J-shaped fitting of FIG. 3 shown in attachment with an indoor side of the bottom sash.
Figure 6:
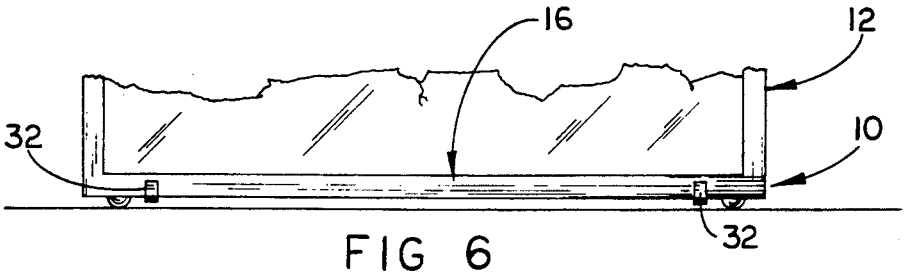
FIG. 6 is a side plan view shown in partial cutaway of a sliding glass door rollably mounted within a supporting frame structure.

To facilitate attachment of the J-shaped members 30 and 32 to the lower portions 18' and 19' of the opposite side walls 18 and 19, attachment means, as best illustrated in FIGS. 3 and 4 are provided including a generally hollow tubular member 50 having a flanged head 52 and threaded hollow interior 54 communicating with an open end 56 thereof, the threaded interior 54 being adapted for threadable engagement with an elongate threaded member 58 extending inwardly and substantially perpendicular to the inner serrated surface 37 on the first J-shaped fitting. The tubular member 50 is adapted for passage through a slot 60 formed in the second J-shaped member 32 and through an aperture formed in the lower portion 19' of the wall 19 so as to extend transversely across the channel 20 and into threadable engagement with the elongate threaded member 58 extending through an aperture in the opposite wall 18. The flanged head 52 is adapted to abuttingly engage a recessed portion 64 formed within an outer surface of the second J-shaped fitting in substantially surrounding relation to the slot 60 so as to force the serrated surface 37 thereof into locking engagement with the corresponding and congruently configured serrated surface 36 on the wall 19 upon threaded engagement and tightening of the tubular member 50 along the length of the elongate threaded member 58. Preferably, the wall 19 is disposed on an indoor side of the sliding glass door so that the second J-shaped fitting 32 and tubular member 50 are only accessible from an indoor area of the house or building. The flanged head 52 preferably includes a hexagonal-shaped recess 53 on its outer end adapted to receive an Allen-type wrench or other tool for threaded advancement of the tubular member 50 along the length of the elongate threaded member 58 so as to effectively attach and lock the first J-shaped fitting and second J-shaped fitting to the lower portions 18' and 19' of the opposite walls 18 and 19, respectively. The position of the J-shaped fittings can be vertically adjusted to accommodate for varying heights of the rollers relative to the lower ends of the walls 18 and 19.

Now that the invention has been described,

What is claimed is:

1. For use on a sliding door of the type removably fitted within a surrounding frame structure, a securing assembly comprising:

a bottom substantially horizontal sash including two opposite, downwardly extending walls disposed in spaced relation so as to define an open channel along a length of a lower side of said bottom sash, said open channel having a plurality of rollers mounted therein, a generally horizontal rail extending along a bottom seal of the frame structure, said rail being structured and configured to support said plurality of rollers in rolling engagement therewith, said rail further including a pair of oppositely disposed grooves extending along a length of said rail on opposite sides of a vertically extending web, retaining means movably attached to said wall of said bottom sash being structured and disposed for preventing lifting and removal of the door from within the frame structure, said retaining means including a pair of fittings formed of a rigid material including a first J-shaped fitting and a second J-shaped fitting each adapted to be oppositely mounted on one of said opposite walls such that a lower hook-shaped portion thereof extend upwardly and substantially within a corresponding one of said grooves, attachment means for removably attaching said first J-shaped fitting and said second J-shaped fitting to said opposite walls of said bottom sash, a lower edge of each of said opposite walls including a substantially reduced thickness being structured and disposed for flush mounting of a corresponding one of said pair of fitting such that an outer surface of each of said walls is flush with an outer surface of said corresponding one of said pair of fittings, an exposed surface of said lower edge of each of said opposite walls including a serrated portion adapted for locking engagement with a congruent serrated surface on an inner side of said corresponding one of said pair of fittings, and said first and said second J-shaped members being vertically adjustable on said lower edge of each of said opposite walls.

2. An assembly as in claim 1 wherein said attachment means includes a hollow tubular member having a head at one end and a threaded interior surface disposed substantially along a length thereof being adapted for threaded receipt with an elongate member attached ton and extending from said first J-shaped fitting.

3. An assembly as in claim 2 wherein said hollow tubular member is sized and configured for passage through a slot in said J-shaped fitting and an aperture extending through an indoor side of one of said walls such that said hollow tubular member threadably engages said elongate member in transverse orientation to said open channel.

4. An assembly as in claim 3 wherein said head on said hollow tubular member is formed and configured for abutting engagement with a recessed area formed on an outer surface of said second J-shaped fitting about said slot such that said threaded engagement of said hollow tubular member with said elongate member forces said first J-shaped member and said second J-shaped member into locked engagement against said lower edge of each of said opposite walls.

5. An assembly as in claim 1 wherein two pairs of H-shaped fittings are removably attached to said bottom sash near opposite ends thereof.

* * * * *